US011465790B2

(12) United States Patent
Van Cauwenberghe et al.

(10) Patent No.: US 11,465,790 B2
(45) Date of Patent: Oct. 11, 2022

(54) BREAD SLICER WITH A PACKING SYSTEM

(71) Applicant: JAC S.A., Liège (BE)

(72) Inventors: Baudouin Van Cauwenberghe, Liège (BE); Jens Rumsfeld, Liège (BE)

(73) Assignee: JAC S.A., Liege (BE)

( * ) Notice: Subject to any disclaimer, the term of this patent is extended or adjusted under 35 U.S.C. 154(b) by 0 days.

(21) Appl. No.: 17/188,550

(22) Filed: Mar. 1, 2021

(65) Prior Publication Data

US 2021/0269185 A1 Sep. 2, 2021

(30) Foreign Application Priority Data

Feb. 27, 2020 (BE) ..... 2020/5132

(51) Int. Cl.

| | |
|---|---|
| ***B65B 25/18*** | (2006.01) |
| ***B65B 5/04*** | (2006.01) |
| ***B65B 43/18*** | (2006.01) |
| ***B65B 43/28*** | (2006.01) |
| ***B65B 63/00*** | (2006.01) |
| ***B65B 43/36*** | (2006.01) |
| ***B26D 1/11*** | (2006.01) |
| ***B26D 7/32*** | (2006.01) |

(52) U.S. Cl.

CPC ..... *B65B 25/18* (2013.01); *B26D 1/11* (2013.01); *B26D 7/32* (2013.01); *B65B 5/045* (2013.01); *B65B 43/18* (2013.01); *B65B 43/28* (2013.01); *B65B 43/36* (2013.01); *B65B 63/00* (2013.01); *B26D 2007/327* (2013.01); *B26D 2210/06* (2013.01)

(58) Field of Classification Search

CPC ..... B65B 5/045; B65B 5/067; B65B 25/16; B65B 25/18; B65B 43/18; B65B 43/28; B65B 43/30; B65B 43/36; B65B 63/00; B26D 1/11; B26D 7/32; B26D 2007/327; B26D 2210/06

USPC ..... 53/435, 459, 516, 570, 385.1, 386.1

See application file for complete search history.

(56) References Cited

U.S. PATENT DOCUMENTS 2,170,312 A * 8/1939 Tuthill et al. ..... B65B 65/02 53/58
2,528,853 A * 11/1950 Brustowsky ..... B26D 5/18 83/751
3,868,807 A * 3/1975 Noyes et al. ..... B65B 43/34 53/459
4,062,169 A * 12/1977 Lister et al. ..... B65B 5/067 53/439

(Continued)

FOREIGN PATENT DOCUMENTS

CA 2539740 A1 9/2006
DE 2424850 A1 * 12/1975 ..... B65B 43/36

(Continued)

*Primary Examiner* — Stephen F. Gerrity

(74) *Attorney, Agent, or Firm* — Browdy and Neimark, PLLC

(57) ABSTRACT

A bread slicer is provided with an input compartment for a loaf of bread and a set of blades designed for cutting a loaf of bread and cooperating with a push block, which enables the loaf to be pushed through the set of blades to an output table. The output table has a bag holder for keeping open a packing bag with the opening facing the set of blades, the push block being arranged to push at least a part of the sliced loaf so as to introduce it at least partially in the packing bag.

11 Claims, 5 Drawing Sheets

(56) References Cited

U.S. PATENT DOCUMENTS

| | | | | |
|---|---|---|---|---|
| 5,095,791 | A * | 3/1992 | Jongerius | B26D 1/50 83/155 |
| 6,935,087 | B2 * | 8/2005 | Simon et al. | A22C 25/18 100/39 |
| 10,695,936 | B2 * | 6/2020 | Herman | B26D 1/00 |
| 2001/0037711 | A1 * | 11/2001 | Van Cauwenberghe | F16P 3/08 83/425.2 |
| 2005/0022467 | A1 * | 2/2005 | Kujubu et al. | B65B 39/02 53/67 |

FOREIGN PATENT DOCUMENTS

| | | | | |
|---|---|---|---|---|
| EP | 2520501 | A1 * | 11/2012 | B65B 25/18 |
| EP | 2556932 | A1 * | 2/2013 | B26D 7/0608 |
| EP | 2111358 | B1 * | 4/2013 | B65B 43/34 |
| EP | 2789539 | A1 | 10/2014 | |
| GB | 442471 | A * | 2/1936 | B26D 7/32 |
| JP | 2006062698 | A | 3/2006 | |
| NL | 2015186 | B1 | 2/2017 | |

* cited by examiner

BREAD SLICER WITH A PACKING SYSTEM

The invention relates to a bread slicer with an input compartment for receiving a loaf of bread to be sliced and with a set of blades comprising oblong blades arranged substantially parallel to each other and such that they can be driven in a back-and-forth movement according to their longitudinal direction. This set of blades is designed for cutting the loaf into slices and cooperates with a push block which enables the loaf bread to be pushed in a direction of travel from the input compartment through the set of blades to an output table. The set of blades is arranged between the input compartment and the output table to cut the bread into slices.

According to the prior art, the sliced loaf is typically manually removed from the output table and placed on a bagging pallet. Next, a bag is slid over the loaf and pallet, and the bag is then removed with the loaf from the pallet.

A disadvantage of such known slicers is that a certain dexterity is required to bag the loaf. Indeed, the slices must not fall and thus break up the loaf while being picked up and transported from the output table to the bagging pallet. Moreover, the slices must be correctly aligned on the bagging pallet in order to be able to bag it properly. The various operations for packing the loaf are also very time-consuming.

Slicers with an automatic packing system are also known, as described in document EP 2789539, for example. The packing system used in these slicers requires the presence of rolls of packing material and does not allow the sliced loaf to be packed in pre-formed or existing bags. In addition, these machines are generally quite complex and bulky.

The invention aims to remedy these disadvantages and to provide a slicer that allows sliced bread to be packed automatically or semi-automatically, in which preformed packing bags can be used. This slicer is relatively compact, however, and limits the number of manual operations to be performed to pack a loaf of bread.

To this end, the output table has a bag holder for holding open a packing bag having an opening, with the opening facing the set of blades as the loaf moves in the direction of travel. The push block is arranged to push at least a portion of the cut loaf through the opening of the bag in said direction of travel to introduce the loaf at least partially into the packing bag.

Advantageously, the bag holder includes a clamping member for holding a lower side of the opening of the packing bag substantially at the level of the output table and an opening device for holding the upper side of the bag at the opening and for moving this upper side away from the lower side until the bag opens, so as to allow the introduction of a loaf of bread.

According to an interesting embodiment of the invention, the output table is inclined with respect to a horizontal plane to hold the slices of the cut loaf against each other while the loaf is being introduced into the packing bag. In particular, the output table is preferably also parallel to the direction of travel of the loaf.

According to a particular embodiment of the invention, the input compartment has a bottom for placing a loaf of bread to be cut on. Preferably, at least the part of this bottom that is adjacent to the set of blades extends parallel to the output table.

The invention also relates to a method for cutting a loaf of bread into slices and for introducing the cut loaf at least partially into a packing bag. According to this method, the loaf is placed in a loading compartment and then the loaf is moved in a direction of travel of the loaf towards an output table. The loaf is sliced between the input compartment and the output table as it moves in said direction of travel through a set of blades comprising oblong blades arranged substantially parallel to each other.

The method is characterized in that a packing bag having an opening is held open at the output table with the opening facing the set of blades. The cut loaf, in particular the cut portion of the loaf, is introduced at least partially into the packing bag according to said direction of travel through the opening of the latter while the loaf is being cut into slices.

Further details and particularities of the invention will become clear from the following description, by way of example without being limitative in any way, of some particular embodiments of the slicer and the method according to the invention, with reference to the accompanying drawings.

In the different figures, the same reference numbers refer to similar or identical elements.

Figure 1:
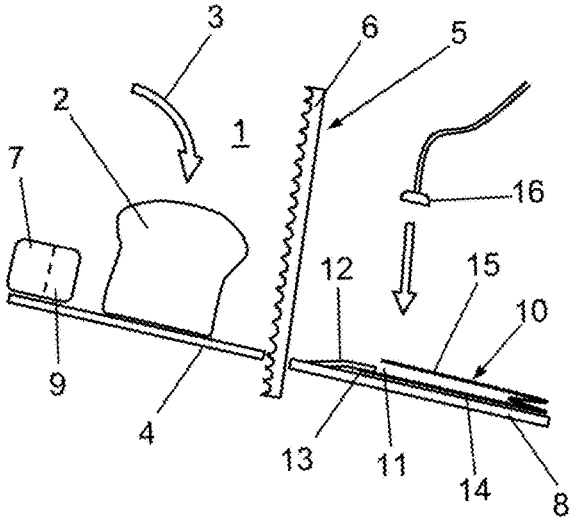
FIG. 1 is a schematic side view of an input compartment, a set of blades and an output table of a slicer according to a particular embodiment of the invention, when a loaf of bread to be cut is introduced into the loading compartment.
Figure 2:
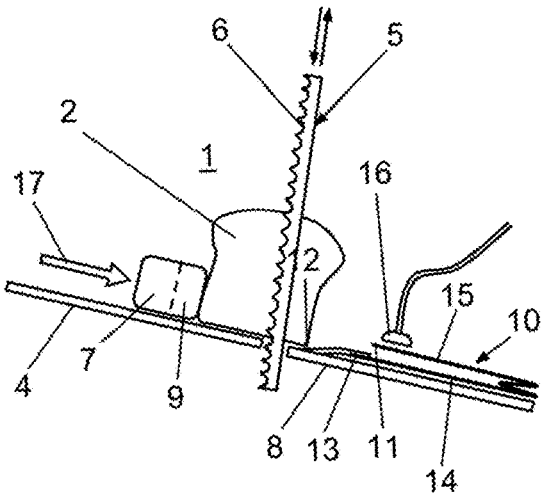
FIG. 2 is a view similar to that in FIG. 1, as the loaf passes through the set of blades.

The invention relates, in general, to a method in which a loaf of bread is sliced and then packed in a preformed bag. The invention also relates to a slicer for implementing this method.

The invention is particularly interesting to be applied in stores where consumers can select a loaf of bread, cut it with an automatic bread slicer and pick up the sliced loaf themselves. The application of the invention is not limited to supermarkets, but can also be used in any place where breads are cut by an automatic slicer, such as in a bakery, for example.

To cut the loaf into slices, it is placed on the bottom of a slicer's input compartment. To cut the loaf into slices, it is pushed by a push block through a set of blades towards an output table from where the sliced loaf is collected by the consumer.

The invention relates, in general, to a system for packing sliced bread in a preformed bag, wherein the sliced bread is introduced into the packing bag in a single movement without the need to manually pick up the bread or move it.

A first embodiment of the slicer and of the method according to the invention is schematically shown in FIGS. 1 to 4. The slicer comprises an input compartment 1 for receiving a loaf 2 to be sliced. As indicated by the arrow 3, the loaf 2 is placed on the bottom 4 of the input compartment 1 of the slicer. A set of blades 5 extends directly adjacent to this compartment 1 and is used to slice the loaf 2.

The set of blades 5 comprises a succession of oblong blades 6 arranged substantially parallel to each other and which can be driven back and forth in their longitudinal direction.

A push block 7 is arranged in the input compartment 1, with which the loaf 2 to be sliced can be pushed in a direction of travel 17 of the loaf 2 from the input compartment 1 through the set of blades 5 to an output table 8. The set of blades 5 is thus arranged between the input compartment 1 and the output table 8. A loaf of bread to be sliced is placed on the bottom 4 of the loading compartment 1 between the push block 7 and the set of blades 5.

Figure 3:
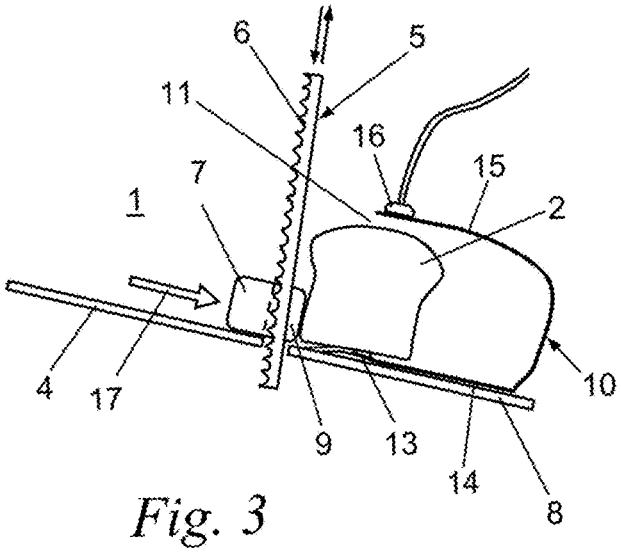
FIG. 3 is a view similar to that of FIGS. 1 and 2, when the cut loaf is pushed into a packing bag.

The push block 7 preferably extends across the entire width of the input compartment 1 and parallel to the plane defined by the set of blades 5. The push block 7 can be driven in the direction of travel of the loaf to push the loaf 2 through the set of blades 5. Preferably, the front side of the push block 7 facing the set of blades 5 has elongated, parallel recesses 9 into which the blades 6 of the set of blades 5 can be accommodated. Thus, the front side of the push block 7 can pass beyond the set of blades 5, as shown in FIG. 3, to push the sliced loaf 2 through the set of blades 5.

The direction of travel of the loaf 2 is indicated by arrow 17 and is generally parallel to the bottom 4 of the input compartment 1 and/or parallel to the side faces of the blades 6 that are part of the set of blades 5.

On the output table 8, a flat-folded packing bag 10 is placed with the opening 11 of the bag 10 facing the set of blades 5. The bag is releasably attached to the output table 8 by a clamp 12. In particular, a lower edge 13 of the opening 11 at the lower side 14 of the bag 10 is clamped between the clamp 12 and the output table 8. Preferably, this lower edge 13 extends beyond the upper edge of the opening 11 of the bag 10, for example to facilitate the attachment of the bag to the support table 8.

Thus, the slicer according to the invention has a bag holder for holding open the packing bag 10 with the opening 11 facing the set of blades 5. This bag holder comprises a clamping element for holding the lower side of the opening 11 of the packing bag 10, in particular said lower edge 13, substantially at the level of the output table 8. In the embodiment of FIGS. 1 to 4, said clamping element comprises the aforementioned clamp 12.

The bag holder also has an opening device for maintaining the upper side 15 of the bag 10 at the opening 11 and for moving this upper side 15 away from the lower side 14 up to the opening of the bag 10 in order to allow the introduction of a loaf of bread 2 into the bag.

In the slicer of FIGS. 1 to 4, this opening device includes at least one suction cup 16 for sucking on and holding the top side 15 of the bag 10 in order to open it and keep it open. As shown in FIG. 1, the suction cup 16 is moved toward the top side 15 of the bag 10, preferably near the opening 11. The suction cup 16 sucks on the top side 15 of the packing bag 10, so that the bag is attached to the suction cup 16. Subsequently, the suction cup 16 is lifted so that the top side 15 of the bag 10 moves away from the bottom side 10 and the bag opens with the opening 11 directed toward the set of blades 5, as shown in FIG. 3.

The slicer may include a single suction cup 16 or a series of suction cups that are arranged next to each other so that they can attach themselves over the entire width of the opening 11 on the top side 15 of the bag.

The distance between the open bag 10 and the set of blades 5 is preferably smaller than the width of the loaf 2 in the direction of travel 17 of the loaf 2, such that the loaf 2 can already be partially introduced into the bag 10 while passing through the set of blades 5.

Figure 4:
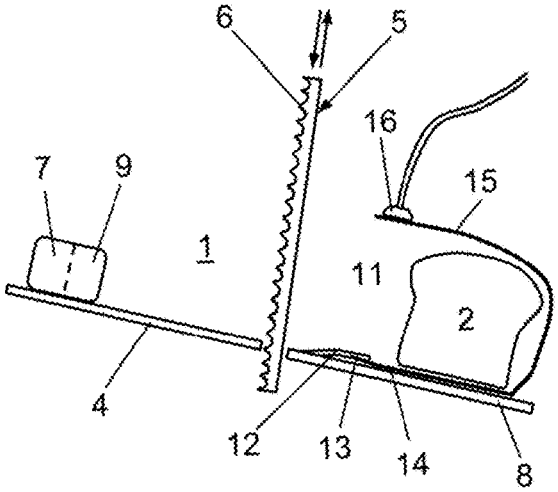
FIG. 4 is a view similar to that of the previous figures when the cut loaf is completely inserted into the packing bag.

After the push block 7 has reached its most advanced position, as shown in FIG. 3, the sucking on the upper side 15 of the bag by the suction cup 16 finishes and the pusher 7 is returned to its initial position as shown in FIG. 4.

In general, according to the invention, the loaf of bread is pushed through the set of blades 5 and introduced into the open bag 10 in a single movement of the push block 7.

In some cases, the sliced loaf 2 is not entirely pushed into the bag 10, but only partially. In that case, the loaf 2 can then be manually advanced further into the bag 10 or it will automatically move further into the bag by gravity when the output table 8 is sufficiently inclined.

When the loaf 2 is entirely in the bag, the bag with the packed loaf is removed. A new loaf of bread 2 to be sliced can be placed in the input compartment 1 then, and a new pre-formed bag is clamped between the clamp 12 and the table 8.

Figure 5:
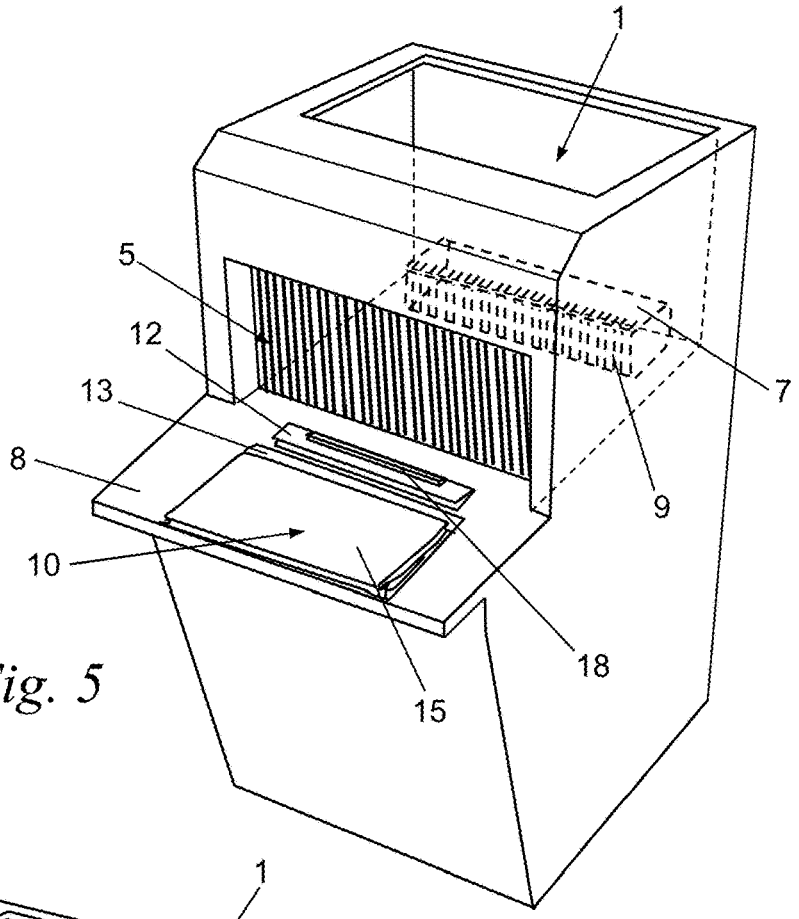
FIG. 5 is a schematic view in perspective of a bread slicer according to an alternative embodiment of the invention.

In FIG. 5, another embodiment of the slicer according to the invention is shown. The main difference between this slicer and that of FIGS. 1 to 4 is the presence of a blow nozzle 18. This blow nozzle 18 is part of the opening device and can, for example, be added to the suction cup 16, or can replace this suction cup 16.

The blow nozzle 18 is preferably provided between the position of the opening 11 of the bag 10 and the set of blades 5. Thus, this blow nozzle is arranged for example between the clamping element, for example the clamp 12, and the set of blades 5. In some cases, it is also possible to provide the blow nozzle 18 behind the set of blades 5 in the input compartment 1. In the latter case, the blow nozzle 18 makes it possible to create an air flow that goes through the set of blades 5 towards the opening 11 of the bag 10.

In general, the blow nozzle 18 is oriented to form an air flow directed towards the opening 11 of the bag 10. Preferably, this air flow is substantially parallel to the lower side 14 of the bag 10 arranged on the output table 8 or, in particular, substantially parallel to the surface of the support table 8.

Thus, this air flow is directed towards the opening 11 of the bag 10 which is folded flat, as shown in FIG. 5, to expand the bag. Thus, the bag 10 is opened by the air flow coming from the blow nozzle 18 and it is also kept open by this air flow with the opening 11 facing the set of blades 5, at least until the loaf 2 is introduced into the bag 10 through the opening 11.

The blow nozzle 18 is thus arranged to generate an air flow towards the surface of the output table 8 and, in particular, substantially in the direction of travel 17 of the loaf 2 so as to open the folded packing bag present at the output table 8 and to keep this bag 10 open.

In the embodiment of the invention shown in FIG. 5, the blow nozzle 18 extends substantially parallel to the plane of the set of blades 5 and over a distance which is preferably less than the width of the bag 10 in this direction. The blow nozzle 18 is formed, for example, by a slot or a succession of openings provided in the surface of the support table 8.

Figure 6:
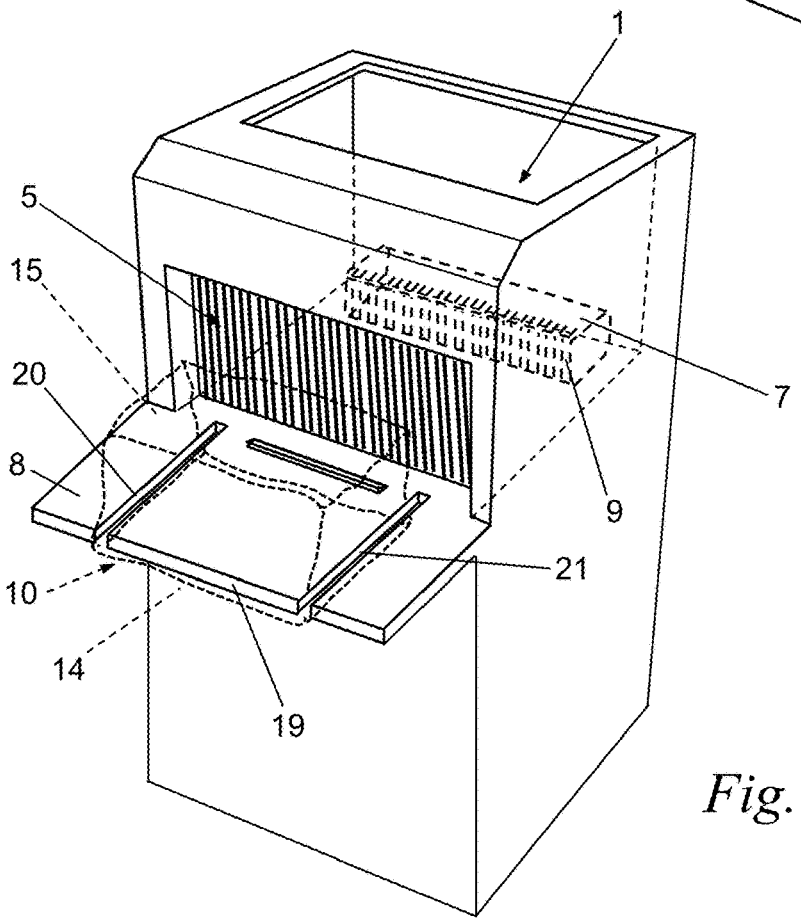
FIG. 6 is a schematic view in perspective of a bread slicer according to another embodiment of the invention.

According to another embodiment of the slicer according to the invention, as shown in FIG. 6, the bag holder comprises a bagging pallet 19 extending substantially at the level of the support table 8. A packing bag 10 for the loaf 2 can be slid onto this pallet 19 with the opening 11 of the bag 10 facing the set of blades 5.

This bagging pallet 19 is, for example, formed by a part of the output table 8 which is laterally limited on both lateral sides by an oblong slot 20 and 21 in the output table 8. These slots 20 and 21 preferably extend parallel to each other and substantially in the direction of travel of the loaf 2. The distance between these slots 20 and 21 corresponds to the length of the bag or is less than this length, so that the bag 10 can be slid onto this pallet 19 with the lower side 14 of the bag below the pallet and the upper side 15 above it. For the clarity of FIG. 6, the bag 10 is shown in dashed lines.

A bagging pallet 19 may replace the bag holder described in connection with the preceding embodiments of the slicer according to the invention. The bagging pallet 19 can, for example, also be applied in combination with one or more suction cups 16 or with a blow nozzle 18.

It is also possible to provide, for example, a clamping element, such as a clamp 12, for clamping or securing the lower side 14 of the bag against the pallet 19 or against the underside of the output table 8. Such a clamping element may, for example, automatically secure the bag 10 to the table 8 when the presence of a bag 10 is detected by a sensor provided for this purpose.

In interesting embodiments of the invention, the bagging pallet 19 may be part of the bag holder and, for example, serve as a clamping element as such.

Figure 7:
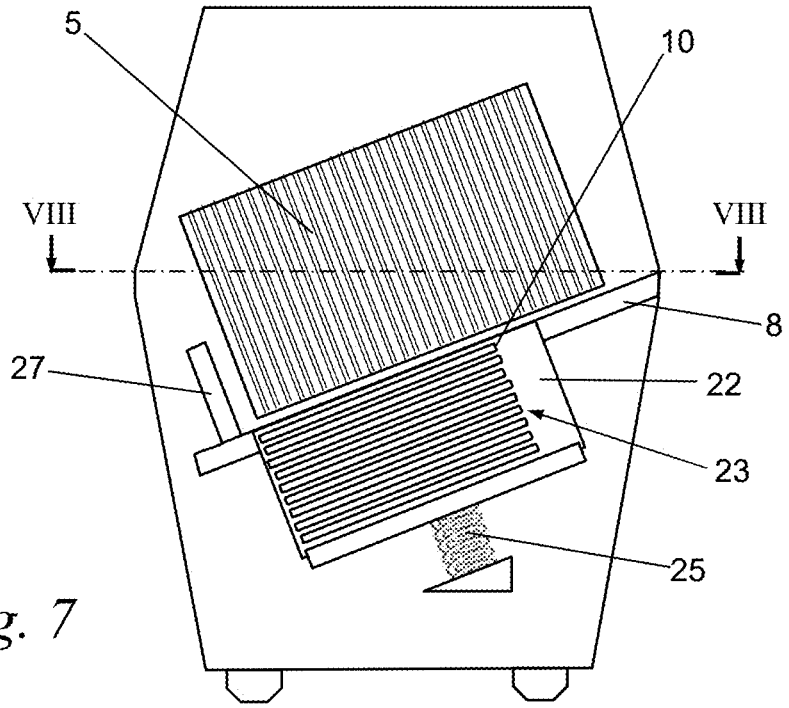
FIG. 7 is a front view of a slicer according to an interesting embodiment of the invention.
Figure 8:
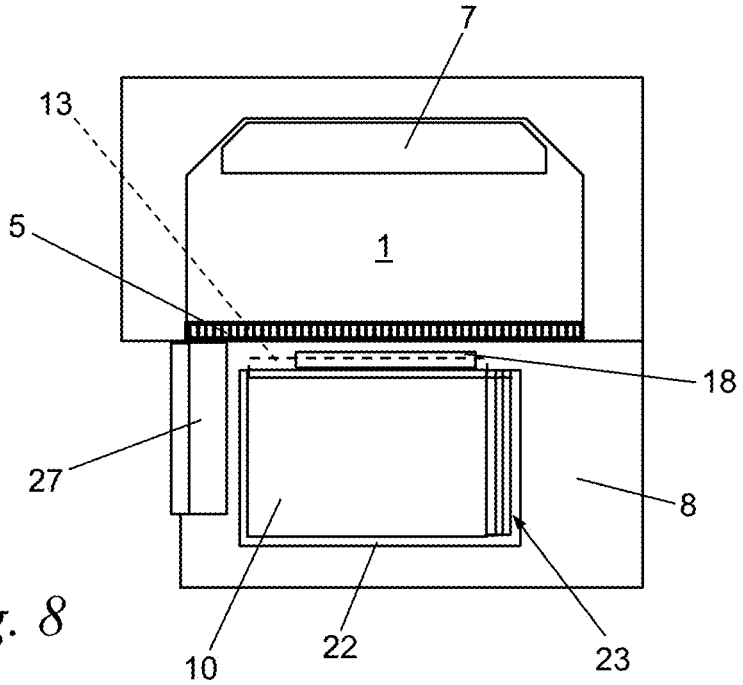
FIG. 8 is a schematic sectional view of the slicer of FIG. 7 according to plane VIII-VIII.
Figure 9:
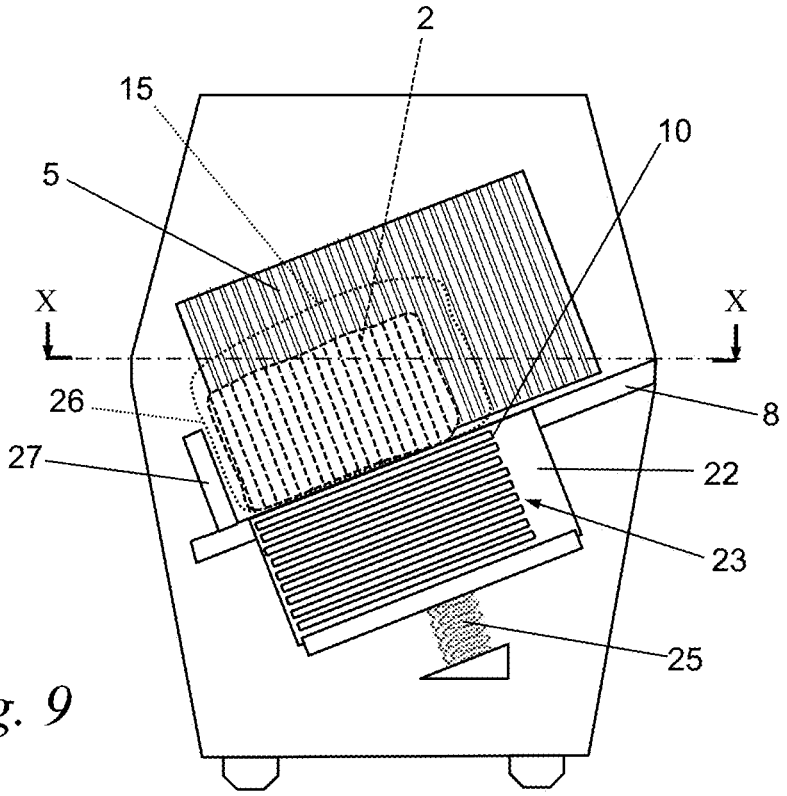
FIG. 9 is a view of the slicer corresponding to that of FIG. 7 when cutting a loaf which is introduced into a packing bag.

In FIGS. 7 to 9, a variant of the preceding embodiments of the slicer according to the invention is shown. In this variant, the support table 8 is inclined with respect to the horizontal plane.

Furthermore, in this embodiment of the slicer according to the invention, the slicer comprises a storage space 22 for accommodating a stack 23 of preformed and flat-folded packing bags 10 with their opening 11 facing the set of blades 5.

This storage space 22 has a movable support 24 for the stack 23 which allows the level of this stack 23 of bags 10 to be adapted so that the upper surface of the stack 23 extends substantially in the upper plane of the output table 8.

The lower side 14 of the bags is provided with a strip protruding from the opening 11. Thus, this protruding strip is formed by the lower edge 13 of the opening 11 at the lower side 14 of the bag 10. This lower edge 13 extends beyond the upper edge of the opening 11 of the bag. Adjacent to the storage space 22, the lower side of the output table 8 has a ledge against which the protruding strip, in particular the edge 13, of the top bag 10 of the stack 23 is clamped. To this end, the movable support 24 is pushed towards the output table 8 by means of, for example, a compression spring 25 mounted between this support 24 and the frame of the slicer. The edge 13 of the top bag 10 of the stack 23 is thus clamped and fixed between the stack 23 of bags and the ledge of the output table 8. The bag holder therefor includes this ledge.

To open the flat-folded top bag 10 from the stack 23, a blow nozzle 18 is provided on the surface of the output table 8 between the set of blades 5 and the storage space 22. Through the blow nozzle 18, air is blown over the opening 11 of the top bag to open it up, so that the opening 11 is straightened opposite the set of blades 5 to allow a loaf of bread to be inserted into this bag 10.

Figure 10:
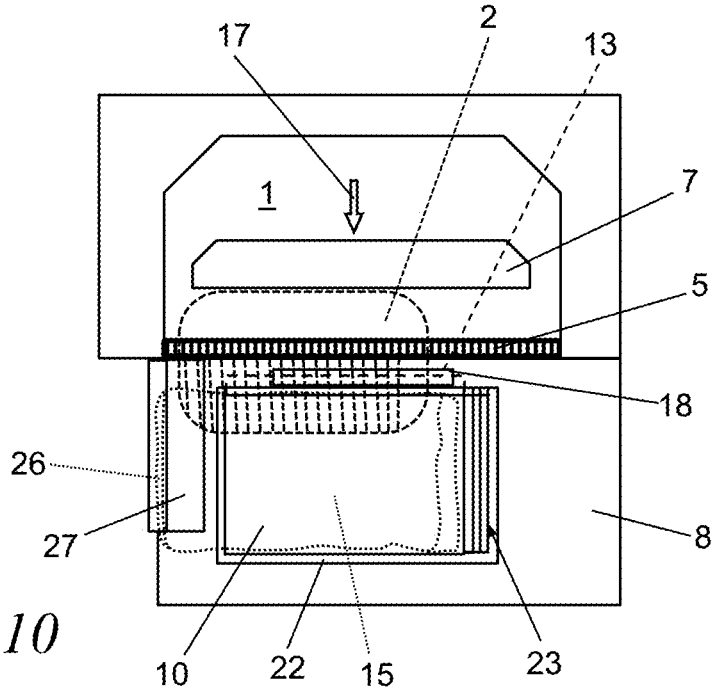
FIG. 10 is a schematic cross-section of the slicer of FIG. 9 according to the section plane X-X.

In FIGS. 9 and 10, the bag 10 is opened and is shown while a loaf of bread is being sliced and, at the same time, inserted into this bag 10. For the clarity of the figures, the bag 10 and the loaf 2 are represented by a dotted line.

After the loaf 2 has been inserted into the bag 10, the bag with the loaf is removed and the next bag in the stack of bags 23 will be automatically presented to receive the next loaf 2.

It is clear that the storage space for packing bags can also be applied in the other embodiments of the slicer according to the invention.

In the slicer concerned, the output table 8 is inclined with respect to a horizontal plane to hold the slices of the cut loaf of bread 2 against each other. Due to the inclination of the output table 8, the sliced loaf leans against the lower lateral side 26 of the bag 10, as illustrated in FIGS. 9 and 10. The slices of the cut loaf 2 also lean against each other while the loaf 2 is being introduced into the packing bag 10. This ensures that the loaf 2 is properly placed in the bag without the slices falling out or coming off each other.

Thus, when cutting the loaf of bread 2 into slices, slices are produced that extend in a plane that is inclined with respect to a vertical plane, so that the slices lean against each other while being inserted into the packing bag 10.

When the output table 8 is inclined, the blades 6 of the set of blades 5 are also inclined. Preferably, the blades 6 extend in parallel planes that are perpendicular to the support table. The side faces of the blades 6 are therefore inclined with respect to a vertical plane.

The slicer also includes a support plate 27 which extends diagonally to the plane of the support table 8 and parallel to the direction of travel 17. This support plate 27 is used to support the lateral side 26 of the bag 10 when the loaf is introduced into the bag. It is clear that this support plate 27 is optional and is not necessary when the bag is held in place by other holding means, such as, for example, a clamp 12.

The other embodiments of the slicer according to the invention, described above, may also have this inclined output table 8. The inclination of the output table with respect to the horizontal plane is, for example, between 10° and 60°.

It is understood that the invention is not limited to the various embodiments described above, but that still other variants can be envisaged while still remaining within the scope of the present invention, in particular as regards the bag holder.

Figure 11:
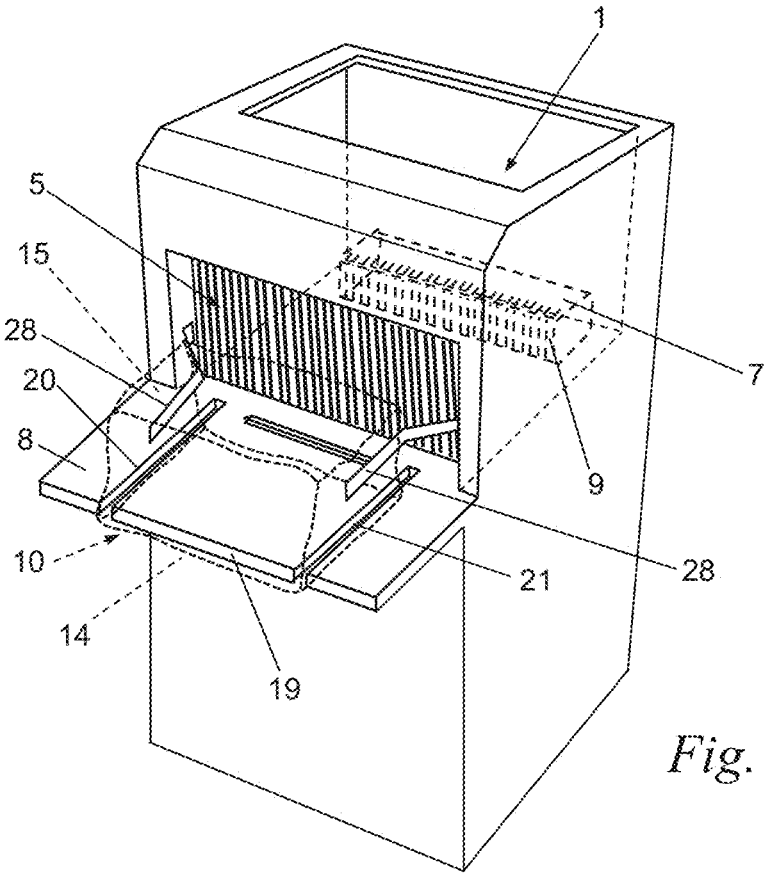
FIG. 11 is a schematic view in perspective of a bread slicer according to another embodiment.

Thus, as shown in the embodiment of FIG. 11, the bag holder may comprise guide fingers 28 arranged to extend on either side of the loaf 2 through the opening 11 of the packing bag 10 to keep the bag 10 open and to guide the loaf 2 as it is being introduced into the bag 10.

By the bag holder is meant, in particular, holding means for holding open a packing bag with the opening facing the set of blades while the loaf is being moved in said direction of travel in order to introduce a cut loaf into the packing bag as it passes through the set of blades or immediately after its passage through the set of blades.

The invention is characterized, in particular, by the fact that a loaf of bread to be sliced is pushed in a single direction and, preferably, in a single movement through the set of blades for slicing it, into a packing bag. According to the prior art, a cut loaf of bread is normally introduced into a bag in a direction that is transverse to the plane of the slices, whereas according to the invention, the loaf is introduced into a bag in a direction that is parallel to the plane of the slices.

The invention claimed is:

1. A bread slicer with an input compartment for receiving a loaf of bread to be sliced and having a set of blades comprising oblong blades having a longitudinal direction and being arranged substantially parallel to each other such that the oblong blades can be driven in a back-and-forth movement in the longitudinal direction, said set of blades being designed for cutting a loaf of bread into slices and cooperating with a push block which enables the loaf to be pushed in a direction of travel from the input compartment through the set of blades to an output table, the set of blades being arranged between the input compartment and the output table to cut the loaf into slices, wherein the output table has a bag holder for keeping open a packing bag having an opening, with the opening facing the set of blades during the movement of the loaf of bread in the direction of travel, the push block being arranged to push at least a part of the sliced loaf through the opening in said direction of travel so as to introduce the sliced loaf at least partially in the packing bag.

2. The bread slicer according to claim 1, comprising a storage space for accommodating a stack of flat-folded packing bags, each having an opening facing the set of blades, the storage space having a movable support for said stack which is configured to adapt a level of the stack of bags so that the upper surface of the stack extends substantially in a plane of the output table.

3. The bread slicer according to claim 1, wherein the bag holder comprises a clamp to hold a lower side of the opening of the packing bag substantially at a level of the output table and an opening device to hold an upper side of the bag at the opening and to move the upper side away from the lower side until the bag opens, so as to allow the sliced loaf of bread to be introduced.

4. The bread slicer according to claim 3, wherein the opening device comprises a blow nozzle arranged to generate an air flow towards a surface of the output table and substantially in the direction of travel of the loaf, to open a flat-folded packing bag which is present at the output table and to keep the packing bag open.

5. The bread slicer according to claim 3, wherein the opening device comprises at least one suction cup for sucking on and holding the upper side of the bag in order to open the bag and keep the bag open.

6. The bread slicer according to claim 1, wherein the bag holder comprises guide fingers arranged so as to extend on either side of the loaf through the opening of the packing bag to keep the bag open and to guide the sliced loaf of bread while the sliced loaf is being introduced in the bag.

7. The bread slicer according to claim 1, wherein the output table is inclined relative to a horizontal plane to hold the slices of the cut loaf against each other during the introduction of the loaf in the packing bag.

8. The bread slicer according to claim 1, wherein the bag holder comprises a bagging pallet extending substantially at a level of the support table on which a packing bag for the loaf of bread can be slid with the opening of the bag facing the set of blades.

9. A method for cutting a loaf of bread into slices and for putting the sliced loaf at least partially in a packing bag, wherein the loaf is placed in an input compartment and the loaf is moved in a direction of travel of the loaf towards an output table, the loaf being cut into slices between the input compartment and the output table as the loaf moves in said direction of travel through a set of blades comprising oblong blades arranged substantially parallel to each other, wherein a packing bag having an opening is being held open at the output table with the opening facing the set of blades and the loaf is introduced at least partially into the packing bag in said direction of travel through the opening of the latter while the loaf is being cut into slices.

10. The method according to claim 9, wherein, while the loaf is being cut into slices, slices are produced which extend in a plane which is inclined relative to a vertical plane, such that the slices lean against each other while being introduced in the packing bag.

11. The method according to claim 9, wherein the loaf which is at least partially cut into slices is introduced in a preformed packing bag in a direction of travel of the loaf which extends parallel to the plane of the slices.

* * * * *